United States Patent [19]

Bunn

[11] Patent Number: 4,610,625

[45] Date of Patent: Sep. 9, 1986

[54] BURNER

[76] Inventor: Richard L. Bunn, 7854 E. 79th, Tulsa, Okla. 74133

[21] Appl. No.: 757,673

[22] Filed: Sep. 23, 1985

[51] Int. Cl.[4] ..... F23Q 9/00

[52] U.S. Cl. ..... 431/284; 431/285; 431/174; 431/182; 431/351; 431/266

[58] Field of Search ..... 431/174, 178, 179, 284, 431/285, 182, 266, 351

[56] References Cited

U.S. PATENT DOCUMENTS

| | | | |
|---|---|---|---|
| 1,808,120 | 6/1931 | Runkwitz | 431/284 |
| 2,395,276 | 2/1946 | Jordan | 431/174 |
| 3,984,196 | 10/1976 | Zenkner | 431/174 |

*Primary Examiner*—Carroll B. Dority, Jr.

*Attorney, Agent, or Firm*—Head, Johnson & Stevenson

[57] ABSTRACT

A gas burner formed of an elongated combustion chamber having a fire wall at one end, an ignition tube extending through an opening in the fire wall, a conductive member within the ignition tube providing means for generating ignition sparks adjacent the end of the tube within the combustion chamber, a plurality of axially directed jet members positioned in the openings in the fire wall and extending into the combustion chamber, a mixing chamber rearwardly of the fire wall having separate fuel and air mixture inlets, a tubular partition within the mixing chamber, air being received on the outside of the tubular partition and gas on the inside and a plurality of secondary air jets extending through openings in the fire wall, each of the secondary discharge jets being configured to discharge air into the combustion chamber in directions tangent to the direction of discharge of the axial jet members so that a column of moving secondary air surrounds the flame of combustion within the combustion chamber.

3 Claims, 3 Drawing Figures

BURNER

BACKGROUND OF THE INVENTION

This invention is directed towards an improved burner for burning gas in a combustion chamber. The burner is adaptable for use in a variety of applications such as in furnaces, steam generators, boilers, and so forth.

A primary consideration in the construction of a gas burner is the provision of means to insure complete efficient combustion of the gas so that no unburned components are discharged. A second consideration is to provide an arrangement wherein the burner components are not rapidly deteriorated as a result of combustion. The present invention achieves these goals plus others in an effective and efficient combustion system. For reference to prior art devices to which the present invention pertains the following U.S. Patents may be considered: U.S. Pat. Nos. 2,443,259; 3,999,935; and 4,347,052.

SUMMARY OF THE INVENTION

The burner is in the form of an elongated combustion chamber having a firewall at one end. A pilot tube, which may also be termed an ignition tube, extends through an opening in the fire wall which is central of the combustion chamber. A conductive member is positioned within the pilot tube providing means for generating ignition sparks. When fuel and air are admitted into the burner the generation of sparks will result in ignition of the pilot flame which is then used for igniting the main combustion gases.

A plurality of jet members are positioned within openings within the fire wall. The jet members are arranged in a spaced relationship about the pilot tube and each jet member extends into the combustion chamber. Rearwardly of the fire wall is a mixing chamber having separate fuel and air mixture inlets. A tubular partition extends rearwardly from the fire wall within the mixing chamber and is positioned so that the openings in the fire wall communicating with the jet members are within the tubular partition.

Spaced about the fire wall and interiorally of the combustion chamber are a plurality of secondary air jets which extend from openings in the fire wall, the openings being exteriorally of the mixing chamber partition.

Air enters the mixing chamber exteriorally of the tubular partition and flows out through the secondary jets. A portion of the air flows into the interior of the tubular partition. Within the tubular partition a fuel distributor is positioned. The injected fuel is mixed in the mixing chamber within the tubular partition and flows through the jets into the interior of the combustion chamber.

The flame produced by combustion of the mixed air and gas discharged into the combustion chamber through the jets is effectively confined to the interior of the chamber by the circuitous flow of secondary air around the flame. This secondary air flow serves the dual purposes of blanketing the wall of the combustion chamber within a cool, oxidizing atmosphere and insuring complete combustion of all fuel components.

DESCRIPTION OF THE PREFERRED EMBODIMENT

Figure 1:
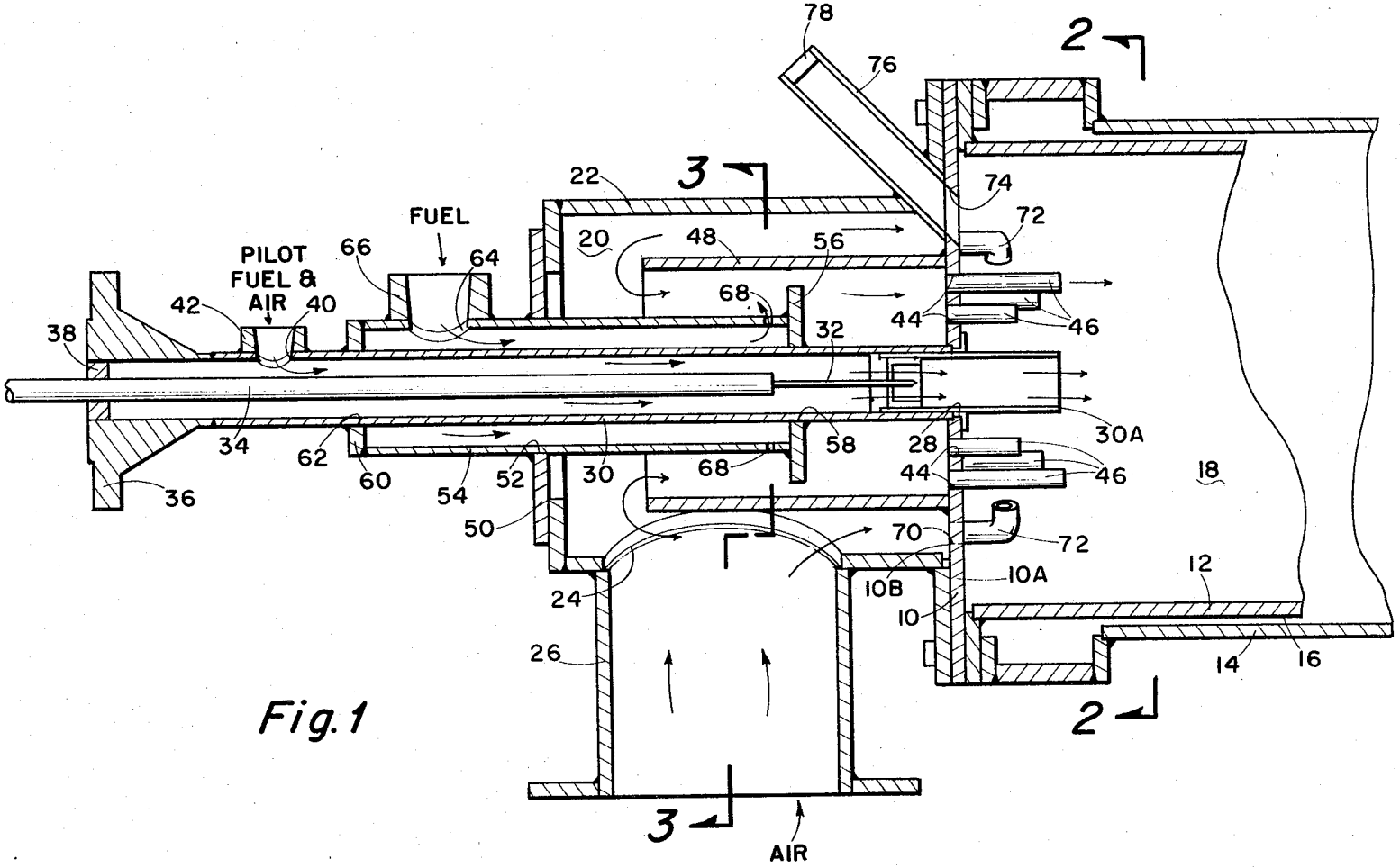
FIG. 1 is an elevational cross-sectional view of a burner of this invention.
Figure 2:
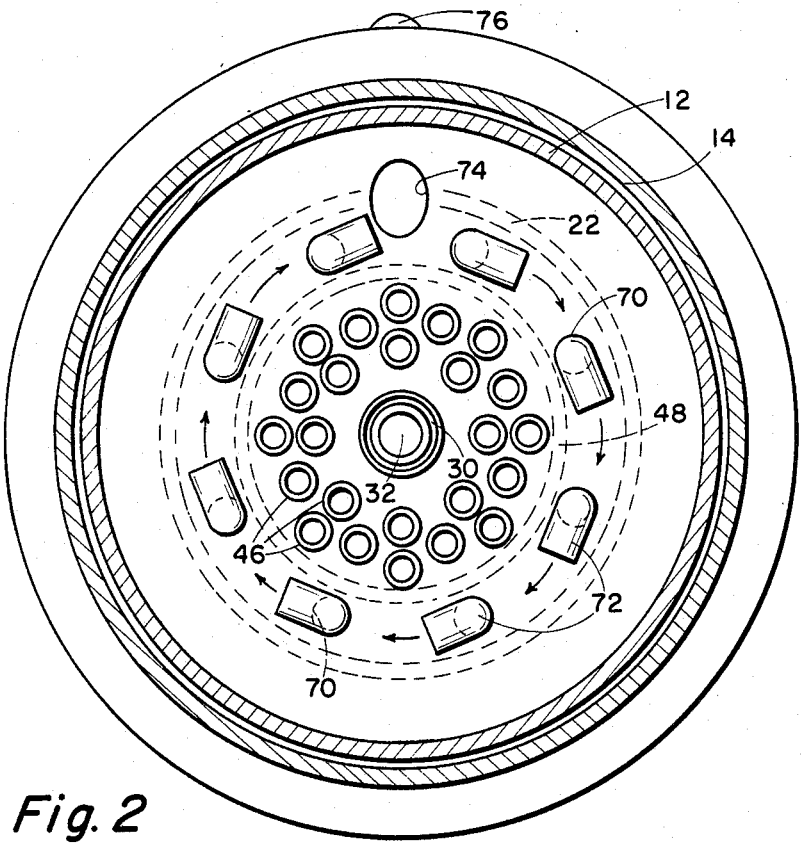
FIG. 2 is a cross-sectional view taken along the line 2—2 of FIG. 1 showing the combustion chamber in cross-section and showing the forward face of the fire wall with the ignition tubes, jet tubes and secondary air tubes extending from it.
Figure 3:
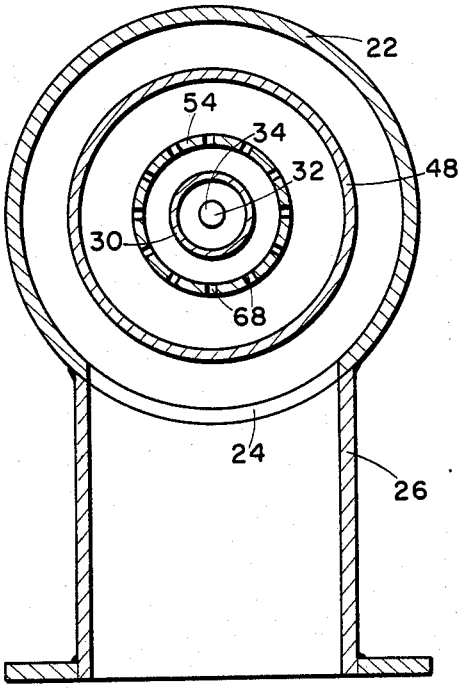
FIG. 3 is a cross-sectional view taken along the line 3—3 of FIG. 1 showing the combustion chamber and air inlet.

Referring to FIGS. 1, 2 and 3, a preferred embodiment of a burner incorporating the principles of this invention is illustrated. The burner includes a vertical fire wall 10. Extending from the fire wall forward face 10A is a burner housing 12. Surrounding the burner housing is a circumferential shell 14 providing an annular space 16 which may receive the flow of water so as to keep housing 12 cool. The interior of the burner housing 12 forms a combustion chamber 18.

Rearwardly of the fire wall 10 is a mixing chamber 20 formed by a cylindrical mixing chamber housing 22. An opening 24 in housing 22 receives a cylindrical air duct 26.

Formed in the fire wall 10 is a central opening 28 which receives the inner end of a pilot tube 30. Within the pilot tube is a conductor 32, the rearward portion of which has insulation 34. The rearward end of the pilot tube is provided with flange 36 by which it may be affixed to a support structure (not shown). The insulated conductor 32, 34 extends rearwardly through flange 36 and the pilot tube is closed by a collar 38. In the cylindrical wall of the tube an opening 40 receives a fitting 42 by which a mixture of fuel and air can be admitted into the interior of the pilot tube. When the ignition of the pilot fuel and air is required high voltage potential can be applied to conductor 32 to cause sparks between it and the wall of the pilot tube, igniting the pilot fuel and air. This produces a flame which flows past the inner end 30A into the interior of the combustion chamber 18.

Formed in the fire wall 10 are a plurality of openings 44, each of which receives a tubular jet member 46. The jet members are preferably arranged in concentric circles about the pilot tube 30 and are preferably, but not necessarily, of increasing length in proportion to their spacing away from the pilot tube.

Affixed to the fire wall rearward surface 10B is one end of a tubular partition member 48, the partition member being of less diameter and less length than the mixing chamber housing 22.

The mixing chamber housing 22 is closed at its rearward end with a vertical wall 50 having an opening 52 which receives a fuel admission cylinder 54. The forward end of the fuel admission cylinder 54 is closed by a flange 56 having an opening 58 receiving the pilot tube 30 and, in like manner, the rearward end is closed by a flange 60 having an opening 62 which receives the pilot tube 30. Formed in the cylindrical wall of the fuel admission cylinder is an opening 64 communicating with a fitting 66 by which fuel gas is admitted into the interior of the fuel admission cylinder. Formed in the fuel admission cylinder forward end adjacent flange 56 are a number of small diameter fuel outlet openings 68 which communicate with the interior of the tubular partition 48.

Formed in the fire wall 10 are a number of secondary air openings 70 (See FIG. 2) which are spaced at a distance from the fire tube 30 so as to communicate with the rearward face of the fire wall exteriorally of the tubular partition 48. Fitted in each of these openings 70 is a secondary air jet 72, the outer end of which is bent at an angle of approximately 90°.

A sight opening 74 in fire wall 10 receives a sight tube 76 which is closed by a glass cylinder 78 at the outer end. The sight tube 76 is not concerned with combustion of gases but provides a means for observing the combustion process within the combustion chamber 18.

OPERATION OF THE BURNER

To initiate the burning of gas in the apparatus shown in FIGS. 1, 2 and 3 a combination fuel and air mixture is inserted into the interior of the burner. The gas and air mixture flows out the end of the pilot tube into combustion chamber 18. Voltage is applied to conductor 32 of sufficient magnitude to cause sparks which ignite the fuel and air mixture so that a pilot flame emerges from the end of a pilot tube 30 in the interior of the combustion chamber 18.

Main combustion is achieved by injecting fuel through fitting 66 into the interior of the fuel admission cylinder 54 and simultaneously injecting air through air duct 26 into the mixing chamber 20. Fuel from within the fuel admission cylinder flows out through openings 68 into the interior of tubular partition 48. Air flows from within the mixing chamber 20 into the interior of the tubular partition 48 and within the partition the air and fuel are mixed and flow out through jets 46. The mixed fuel and air is ignited by the pilot flame from pilot tube 30 and combusiton takes place within the confines of the combustion chamber housing 12.

Simultaneously, air from the mixing chamber 20 also flows through the secondry air jets 72 into the combustion chamber. There is no fuel component in the air flowing through the air jets 72. The force of air flowing through the jets causes a circular flame pattern within the combustion chamber 18 so that combustion is confined to the interior of the chamber and the secondary air forms a cooling shield on the outside of the pattern. Further, the secondary air completes the combustion of the gas and air mixtures flowing into the combustion chamber through jets 46.

The burner provides a balanced system around the pilot tube. The flame of combustion is centrally located and retained within the combustion chamber by the swirl caused by the circular flow of secondary air.

The combustion chamber 12 and shell 14 may be part of a furnace, a steam generator, a boiler, or any other commercial apparatus which utilizes heat from burning gas.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A gas burner comprising:

an elongated combustion chamber defined in part by the forward surface of a fire wall;

an ignition means extending through an opening in said fire wall and having one end thereof centrally positioned within said combustion chamber;

said ignition means including a pilot tube and a conductive member received within said pilot tube providing means for generating ignition sparks within said pilot tube adjacent the end thereof within said combustion chamber;

a plurality of jet openings in said fire wall in spaced relationship around and spaced from said pilot tube;

a jet member received within each said jet opening and extending into said combustion chamber;

a mixing chamber defined in part by the rearward surface of said fire wall, the mixing chamber having separate fuel and air inlets;

a tubular partition received within said mixing chamber, one end of the tubular partition being secured to said fire wall rearward surface said pilot tube being received concentrically within said tubular partition and said jet openings communicating with the interior of the tubular partition;

said fire wall having a plurality of spaced apart secondary air openings therein communicating with said mixing chamber exteriorally of said tubular partition; and a secondary air jet secured to said fire wall within said combustion chamber in communication with said secondary air openings, each said secondary air jet including means to discharge air into said combustion chamber in directions tangent to the longitudinal axis of said combustion chamber.

2. A gas burner according to claim 1 wherein said jet openings and said jet members are arranged concentrically about said pilot tube in a plurality of increasing radius circles.

3. A gas burner according to claim 2 wherein said jet members are tubular and are of increasing length in larger diameter circles.

* * * * *